United States Patent [19]

van Laar et al.

[11] Patent Number: 4,749,446

[45] Date of Patent: Jun. 7, 1988

[54] HORIZONTAL COKE-OVEN BATTERY

[75] Inventors: Jacobus van Laar, Santpoort; Jacob Felthuis, Oudorp; Antonius J. Horio, Warmenhuizen, all of Netherlands

[73] Assignee: Estel Hoogovens B.V., Ijmuiden, Netherlands

[21] Appl. No.: 597,560

[22] Filed: Apr. 6, 1984

Related U.S. Application Data

[63] Continuation of Ser. No. 352,853, Feb. 26, 1982, abandoned.

[30] Foreign Application Priority Data

Mar. 5, 1981 [NL] Netherlands ..... 8101060

[51] Int. Cl.[4] ..... C10B 5/02

[52] U.S. Cl. ..... 202/139; 202/133; 202/141

[58] Field of Search ..... 202/133, 139, 141-144, 202/222-224, 267 R, 269, 270; 432/74, 238, 252; 120/336

[56] References Cited

U.S. PATENT DOCUMENTS

| | | | |
|---|---|---|---|
| 1,757,988 | 5/1930 | Wilhelm . | |
| 2,098,013 | 11/1937 | Pavitt | 202/269 |
| 2,537,670 | 1/1951 | Horner et al. | 202/269 |
| 2,761,826 | 9/1956 | Van Ackeren | 202/269 |
| 4,033,827 | 7/1977 | White | 202/269 |
| 4,193,355 | 3/1980 | Dondeyne et al. | 110/336 |
| 4,259,159 | 3/1981 | Hohler | 202/269 |

*Primary Examiner*—Peter Kratz

*Attorney, Agent, or Firm*—Stevens, Davis, Miller & Mosher

[57] ABSTRACT

A coke oven battery has a refractory brick structure comprising a row of coking chambers (1) between an oven roof (9) and a regenerator roof (10) and a row of regenerative chambers (2) between the regenerator roof (10) and a regenerator floor (11). In order to provide protection (e.g. for an external steel frame) against leakage of inflammable gas, cladding (16–24) of metal foil is provided at both the pusher side and the coke side. This cladding makes a substantially gas tight seal with the refractory brick. The foil preferably has a thickness of 0.05 to 0.25 mm.

11 Claims, 4 Drawing Sheets

HORIZONTAL COKE-OVEN BATTERY

This application is a continuation of application Ser. No. 352,853, filed Feb. 26, 1982, now abandoned.

BACKGROUND OF THE INVENTION

1. Field of the Invention

The invention relates to a horizontal coke-oven battery of the type having coking chambers arranged in a row between an oven roof and a regenerator roof, and regenerative chambers beneath the coking chambers between the regenerator roof and a regenerator floor.

2. Description of the Prior Art

In a conventional coke-oven battery of this type, the oven roof, the regenerator roof, the regenerator floor and various dividing walls between the coking chambers and the regenerative chambers form a refractory brick structure which is supported by a steel construction. This steel construction comprises vertical uprights and horizontal braces, which are intended to keep the brickwork under pressure so as to prevent the formation of cracks due to thermal stresses. Such cracks are undesirable for several reasons. One reason is that cracks in the brickwork give rise to leaks. When inflammable gases leak outwards and ignite, the steelwork may become too hot and deform, so that it ceases to give the brickwork adequate support. This gives rise to increased crack formation, and so on.

Efforts have been made, by installing support plates between the uprights in the furnace roof and the regenerator roof and fitting armour plates between the uprights and the brickwork, to distribute the supporting action of the steelwork over the largest possible area of the brickwork as evenly as possible. Nevertheless it would appear to be practically impossible to prevent leakage of inflammable gases through the brickwork to the outside under all circumstances. This leakage produces the adverse effects on the brickwork described above.

As the combustion chambers of the coke-oven battery operate under a vacuum as a result of chimney draught, cracks in the brickwork, may also interfere with the draught and may result in leakage paths for air and/or gas within the oven construction. This may not only lead to undesirable combustion phenomena within the oven but may also reduce the chimney draught, extend the coking time and cause the fuel gas to preignite.

SUMMARY OF THE INVENTION

The object of the invention is to provide a horizontal coke-oven battery in which the above problems are ameliorated or removed, in particular in which the danger caused by crack formation is reduced.

The invention consists in that, on both the pusher side and the coke side of the battery, a gas-tight cladding of metal foil is provided on the refractory brickwork, the cladding being sealingly connected to the brickwork.

If the brickwork for any reason exhibits porosity or initial crack formation, as a result of which there is a danger that gas may leak to the outside, then the metal foil cladding will keep the brickwork sufficiently gas tight by sealing it to prevent the penetration of the gas to the outside or of air to the inside.

Preferably at the sides of the battery, the cladding extends from about the level of the top of the oven roof to about the level of the top of the coking chambers and from about the level of the bottom of the coking chambers to about the level of the bottom of the regenerative chambers.

The metal foil of the cladding should be chosen so that it remains sufficiently gas-tight under the conditions of operation and so that it retains its shape sufficiently well to provide the brickwork with an effective seal. This means that the metal foil must have low susceptibility to chemical corrosion and must be sufficiently rigid to maintain its shape. The preferred material for this purpose is a non-oxidizable alloy steel foil and the preferred thickness is in the range 0.05 to 0.25 mm. Good results may be achieved in particular with a steel foil measuring 0.10 to 0.15 mm in thickness, preferably 0.12 mm thick. The preferred steel contains 15 to 30% Cr, 5 to 25% Ni and 0 to 10% Mo.

We have found that for simple and effective installation of the protective cladding, the cladding should preferably be predominantly composed of sheets measuring approximately 90×150 cm, these sheets overlapping one another when fitted, each sheet having one or more edges fastened into joints in the brickwork. Another possibility, however, is to install foil direct from a coil.

At the points where, as in existing designs, the coke-oven battery already has armour plates and/or support plates, the metal foil (and in particular the overlapping sections thereof) may advantageously be concealed between these parts and the brickwork.

At various places it is usual to have detached outer brick walls. At these points, for example, adjacent the regenerative chambers, it is possible for the detached brick wall to be in front of the foil, thus protecting the foil from the exterior. The likelihood of mechanical damage to the foil is thus considerably reduced. With a structure having a detached brick wall located at each end of the regenerative chambers, however, the bending of the metal foil so that it forms an uninterrrupted protective seal may be no easy task. Preferably the top and bottom ends of the detached brick walls are also provided with extra protection at their top and bottom faces, their rear faces and their side faces using separate pieces of metal foil.

Where support plates are provided at the level of the oven roof and/or the regenerator roof between the brickwork and a steel support construction, preferably a layer of thermal insulation material is provided between each support plate and the metal foil, which is adjacent the brickwork. The insulation material keeps the support plates cool and is itself protected by the metal foil.

BRIEF INTRODUCTION OF THE DRAWINGS

The preferred embodiment of the invention will now be described by way of non-limitative example with reference to the accompanying drawings, in which.

DESCRIPTION OF THE PREFERRED EMBODIMENT

Figure 1:
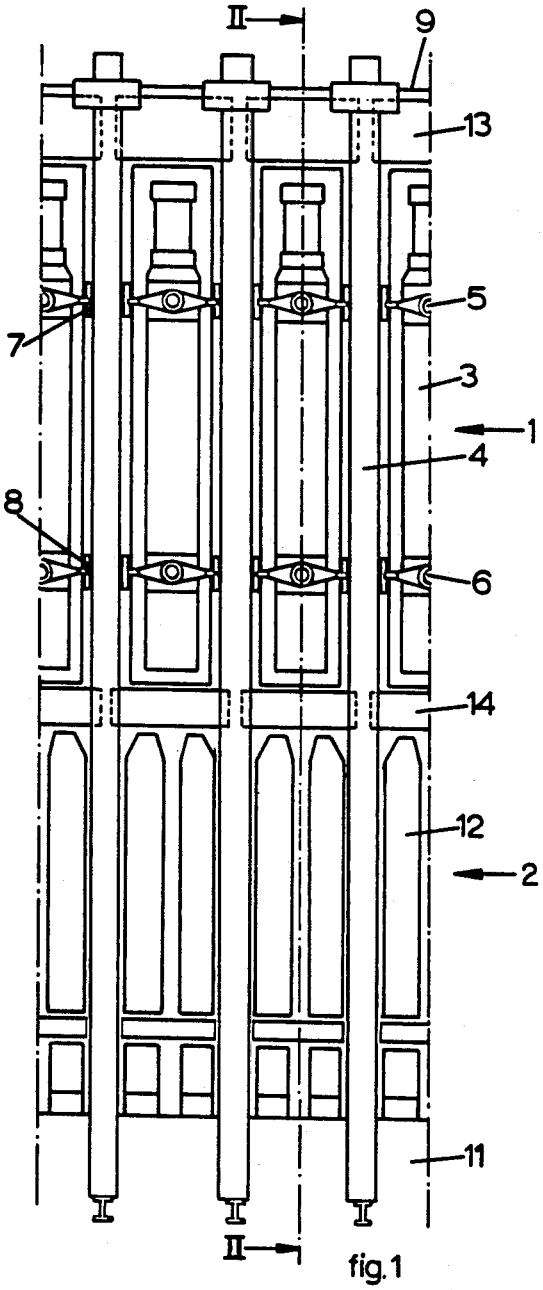
FIG. 1 is a diagrammatic side view of a known design of coke-oven battery.
Figure 2:
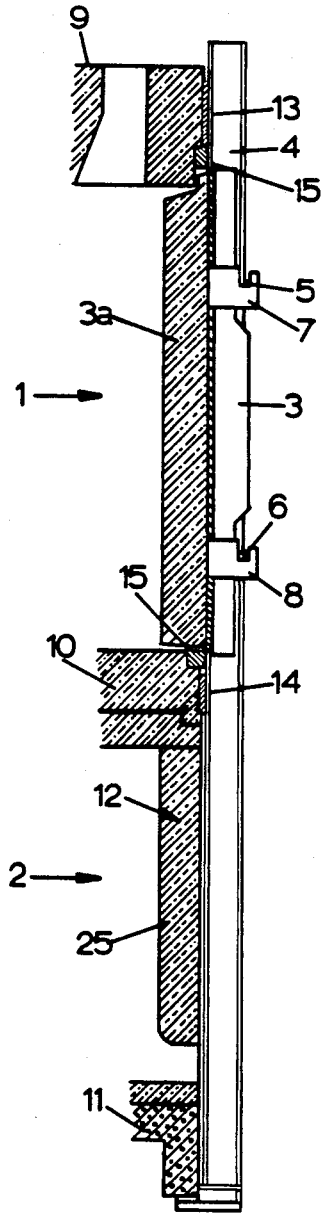
FIG. 2 is a diagrammatic cross-section along the line II—II in FIG. 1.

FIGS. 1 and 2 show the coking chambers 1 of a horizontal coke-oven battery. The regenerative chambers 2 are located beneath the coking chambers 1. Each of the coking chambers is closed by a door 3 which is fastened by means of clamps 5 and 6 in cradles 7 and 8. The door is provided with refractory brickwork 3a. The coking chambers 1 are in a row between an oven roof 9 at the top and a regenerator roof 10 at the bottom. Beneath the regenerative chambers 2 is a regenerative floor 11. The regenerative chambers 2 are closed at their ends (i.e. at the side of the battery) by brick walls 25. The whole structure comprising oven roof 9, regenerator roof 10, regenerator floor 11 and the dividing walls between the adjacent pairs of coking chambers 1 and the adjacent pairs of regenerative chambers 2, as well as the end walls 25 is formed of refractory brickwork.

Uprights 4 of steel are located in the front of the battery between each adjacent pair of coking chambers to provide support for the brickwork construction. Steel support plates 13 and 14 are also fitted for this purpose between the uprights 4 and the oven roof and the regenerator roof respectively. It is also possible for armour plates (not shown in the drawings) to be installed from top to bottom of the construction between the uprights 4 and the brickwork to distribute the pressure. The uprights 4 on the two sides of the battery may be connected by ties (not shown) extending through the roof 9.

The coking chamber doors 3 are fitted in a gas-tight manner in the coking chamber openings. For this purpose, steel door frames 15 are fitted around these openings.

Figure 3:
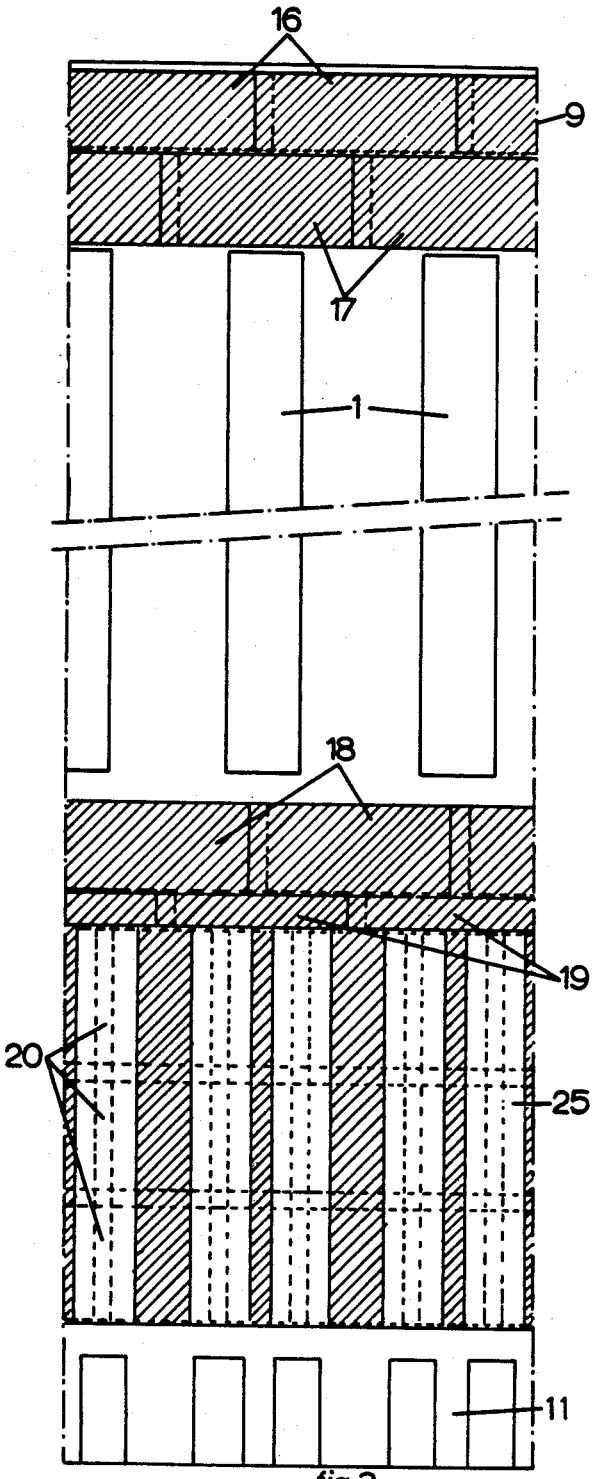
FIGS. 3 and 4 are views similar to that of FIG. 1 but on an enlarged scale, indicating certain features in accordance with the invention.

FIG. 3 is a view similar to that of FIG. 1 but omitting the uprights 4, doors 3, support plates 13 and 14 and door frame 15 and shows how, in accordance with the invention, metal foil sheets 16 are fitted so as to overlap along the top of the side edges of the oven roof 9. Below this row of sheets 16, there are sheets 17 of metal foil which again overlap one another. In the same way, the edge of the regenerator roof 10 is fitted with rows of sheets 18,19 of foil and ends of the regenerative chambers 2 are covered with vertically extending sheets 20 of metal foil.

In this embodiment, all these sheets 16–20 of metal foil are of 0.12 mm thick steel containing 18% Cr and 8% Ni. Such foil is thin enough to be easily shaped and installed, but provides sufficient protective effect and is sufficiently rigid to maintain its shape. As far as possible, a unit size of 90×150 cm was used, but although these dimensions will naturally be adapted to the particular embodiment. The overlaps of the sheets are indicated by means of broken lines in the Figures.

The sheets 16–20 are sealingly connected to the brickwork, as described below, and to each other so as to form a gastight protective cladding for the brickwork at the regions which they cover. This cladding provides an excellent seal against leakage of gas through the brickwork to the exterior or vice versa.

Figure 5:
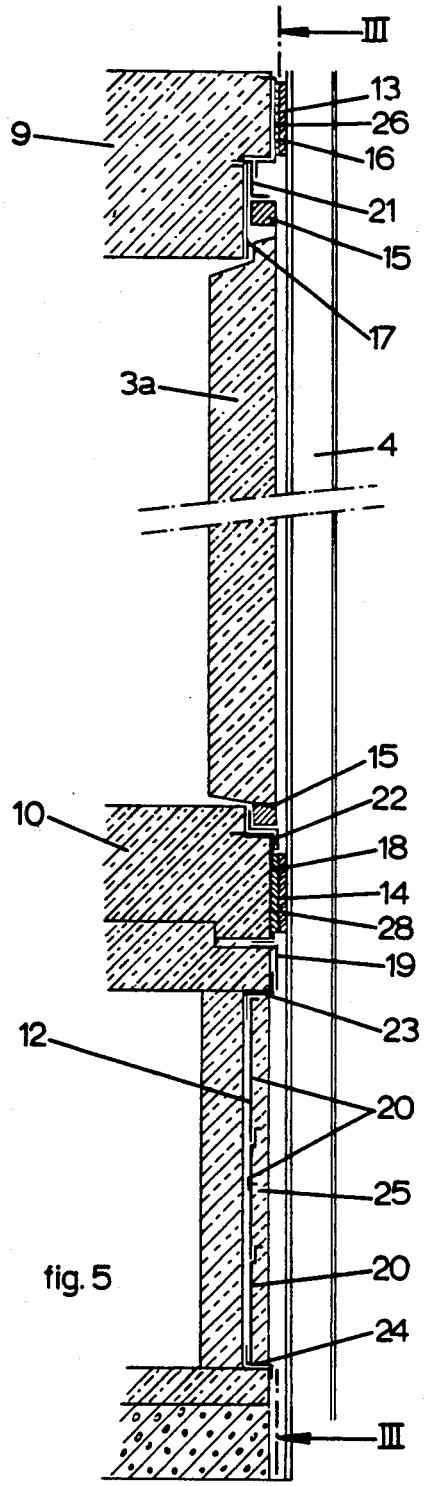
FIG. 5 is a sectional view, corresponding to that of FIG. 2 showing the construction embodying the invention.

FIG. 5 is a cross-sectional view similar to FIG. 2 but showing the sheets of metal foil applied in accordance with the invention. In contrast to FIG. 3, the uprights 4, pressure plates 13 and 14, door frame 15 and door brickwork 3a are shown in FIG. 5. The line III—III in FIG. 5 is the line of the view of FIG. 3. FIG. 5 also shows how the sheets 16 and 18 are fitted behind the pressure plates 13 and 14 between these plates and the brickwork. Between the pressure plates 13 and 14 and the sheets 16 and 18 respectively, plates of thermally insulating ceramic material 26 and 28 are fitted to keep the steel construction cool. FIG. 5 also shows that, at regenerative chamber recesses 12, there are two layers of brickwork at the ends of the chambers 2, with the sheets 20 of metal foil partly concealed behind the front detached (outer) layer 25. It will be noted that the parts of the sheets 20 which do not fit behind the brick layer 25 are protected by uprights 4.

FIG. 5 shows how the various sheets 16,17,18,19 and 20 are bent in order to obtain an effective seal against the brickwork, and in particular how the top edges of these sheets fit into joints in the brickwork. Some of these joints may be moving ones.

Figure 4:
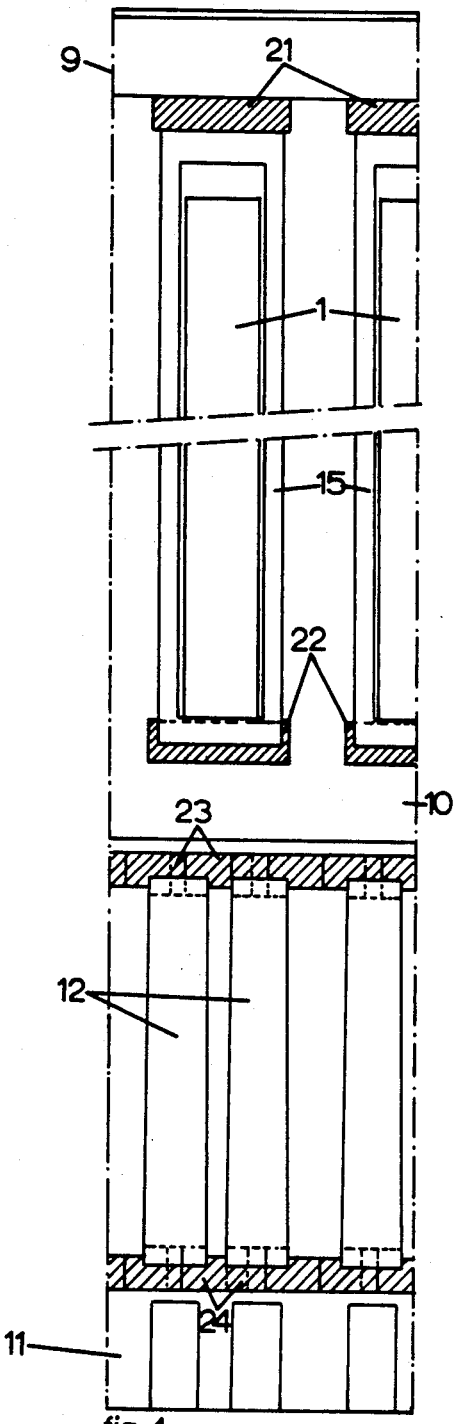
Figure 6:
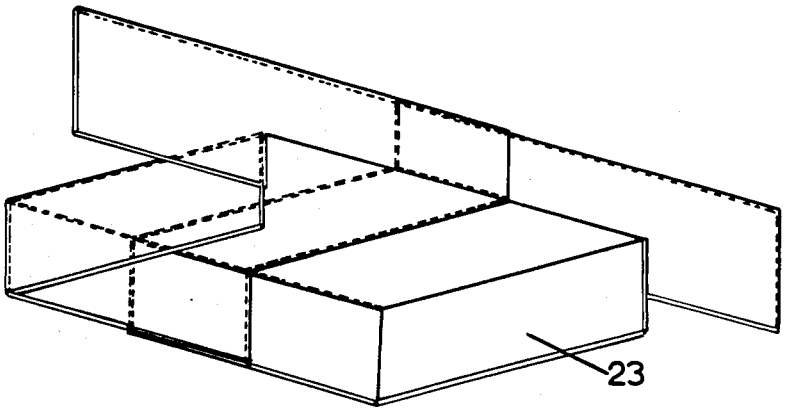
FIGS. 6 and 7 show, in perspective, two foil parts from FIGS. 4 and 5, on an enlarged scale.
Figure 7:
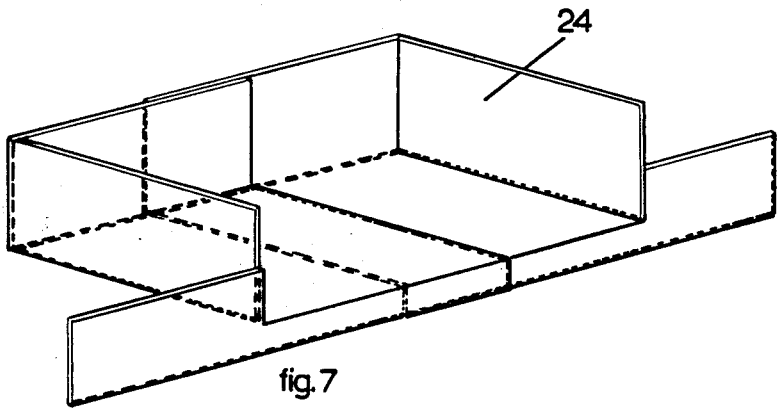

At a number of critical points, it will not be a simple matter to arrange abutting sheets of metal foil so that they overlap to provide an efficient seal. For this purpose, an extra layer is installed behind the sheets shown in FIG. 3, these extra layers being shown in FIG. 4. In the FIGS. 3 and 4, the parts of the sheets which are visible when assembled are shaded. The covered parts of foil are shown unshaded. Above the door frame 15, there is an extra layer 21 which is a strip attached by its top edge in the brickwork and with its bottom edge covered by the door frame 15. On the underside of the door frame 15, there is a strip 22 fitted between the regenerator roof and this frame. The strip 22 extends in front of the sheet 18 to behind pressure plate 14. The sheet elements 23 and 24 each consist of two bent pieces of foil sheet which are shown in more detail, in perspective, in FIGS. 6 and 7. The two parts of elements 23 are bent in such a way that they protect the upper end of the brickwork layer 25 at its top, rear and sides, this element being concealed behind sheets 19. In a similar way, the element 24, which is composed of two folded, interleaved sheets of foil, is shaped as shown in FIG. 7 so that it protects the bottom end of brickwork 25 at its bottom face, rear and sides.

What is claimed is:

1. In a horizontal coke-oven battery having a plurality of coking chambers arranged in a row between an oven roof and a regenerator roof and, beneath the coking chambers, a plurality of regenerative chambers arranged in a row between the regenerator roof and a regenerator floor, the oven roof, regenerator roof, the regenerator floor and the walls of the coking chambers and regenerative chambers being of refractory brickwork, and protective metal sheeting being arranged outside at least parts of the refractory brickwork, the improvement wherein:

at both the pusher side and the coke side of the battery, at least parts of the said refractory brickwork have a gas-tight protective cladding formed of metal foil which is sealingly connected to the brickwork, said protective cladding of foil extending, at each side of the battery, at least from adjacent the level of the top of the oven roof to about the level of the top of the coking chambers and from about the level of the bottoms of the coking chambers to about the level of the bottoms of the regenerative chambers, said foil cladding being formed by a plurality of foil sheets which overlap one another and are secured at one or more edges by edge portions located in joints in the brickwork.

2. In a coke-oven battery according to claim 1, wherein the foil has a thickness in the range of 0.05 to 0.25 mm.

3. In a coke-oven battery according to claim 2 wherein the foil has a thickness in the range of 0.010 to 0.015 mm.

4. In a coke-oven battery according to claim 2 wherein the foil is constructed of an oxidation-resistant alloy steel.

5. In a coke-oven battery according to claim 2 wherein said steel contains 15 to 30% Cr, 5 to 25% Ni and 0 to 10% Mo.

6. In a coke-oven battery according to claim 2 wherein the foil has a thickness of about 0.12 mm.

7. In a coke-oven battery according to claim 1 wherein a detached additional brick wall is provided, at the location of the regenerative chambers, in front of the foil cladding.

8. In a coke-oven battery according to claim 7 wherein the top and bottom of the detached wall are provided with protective metal foil claddings which cover the top and bottom of the wall and the side and rear faces of the wall adjacent the top and bottom.

9. In a coke-oven battery according to any one of claims 1 and 2 wherein the oven roof and/or the regenerator roof have, at the pusher and coke sides, steel support plates and the protective foil cladding extends between the support plates and the refractory brickwork of the roofs, there being layers of thermally insulating material between the support plates and the foil cladding.

10. A horizontal coke-oven battery having a pusher side, a coke side, and a refractory brick structure comprising an oven roof, a regenerator roof below and spaced from the oven roof, a regenerator floor below and spaced from the regenerator roof, a plurality of coking chambers arranged in a row between the oven roof and the regenerator roof and extending between the coke side and the pusher side, a plurality of regenerative chambers arranged in a row between the regenerator roof and the regenerator floor and extending between the coke side and the pusher side, and a protective gas-tight cladding formed of metal foil covering at least parts of the refractory brick structure on both the pusher and coke sides and sealingly connected to the brick structure, said foil protective cladding covering, on each of the pusher and coke sides, at least the side edges of the oven roof and the regenerator roof and the sides of the regenerative chambers, said foil cladding being formed by a plurality of foil sheets which overlap one another and are secured at one or more edges by edge portions located in joints in the brick.

11. A coke-oven battery according to claim 10 wherein the foil of said cladding has a thickness in the range of 0.05 to 0.25 mm.

* * * * *